US007707923B2

(12) United States Patent
Gussalli Beretta

(10) Patent No.: US 7,707,923 B2
(45) Date of Patent: May 4, 2010

(54) SHORT RECOIL SEMI-AUTOMATIC SHOTGUN

(75) Inventor: Ugo Gussalli Beretta, Brescia (IT)

(73) Assignee: Fabbrica D'Armi Pietro Beretta S.p.A., Gardone Val Trompia, Brescia (IT)

( * ) Notice: Subject to any disclaimer, the term of this patent is extended or adjusted under 35 U.S.C. 154(b) by 0 days.

(21) Appl. No.: 12/018,646

(22) Filed: Jan. 23, 2008

(65) Prior Publication Data

US 2008/0173168 A1 Jul. 24, 2008

(30) Foreign Application Priority Data

Jan. 24, 2007 (IT) ..... MI2007A0106

(51) Int. Cl.
*F41A 3/46* (2006.01)

(52) U.S. Cl. ..... 89/173; 42/8; 42/40; 89/174; 89/176

(58) Field of Classification Search ..... None
See application file for complete search history.

(56) References Cited

U.S. PATENT DOCUMENTS

| | | | | |
|---|---|---|---|---|
| 1,802,198 | A | 4/1931 | Cosmi | |
| 2,395,211 | A | 2/1946 | Bell et al. | |
| 2,962,935 | A | 12/1960 | Hepperele | |
| 3,171,225 | A | 3/1965 | Green et al. | |
| 3,996,685 | A * | 12/1976 | Bauman et al. | 42/17 |
| 4,957,028 | A * | 9/1990 | Lieberum et al. | 89/47 |
| 4,976,059 | A * | 12/1990 | Marzocco | 42/46 |
| 5,433,027 | A * | 7/1995 | Sprangers | 42/45 |
| 5,459,956 | A * | 10/1995 | Rowlands et al. | 42/47 |
| 5,469,649 | A * | 11/1995 | Rowlands et al. | 42/43 |
| 6,142,058 | A * | 11/2000 | Mayville et al. | 89/126 |
| 6,705,035 | B2 * | 3/2004 | Gussalli Beretta | 42/40 |
| 6,931,978 | B1 * | 8/2005 | Dionne | 89/194 |
| 6,935,063 | B1 * | 8/2005 | Johnson | 42/40 |
| 7,316,092 | B2 * | 1/2008 | DeLeeuw | 42/51 |
| 2002/0139241 | A1 * | 10/2002 | Butler | 89/191.01 |
| 2003/0089015 | A1 * | 5/2003 | Beretta | 42/40 |
| 2004/0128898 | A1 * | 7/2004 | Popikow | 42/47 |
| 2004/0144008 | A1 * | 7/2004 | Popikow | 42/40 |
| 2005/0011346 | A1 * | 1/2005 | Wolff et al. | 89/12 |
| 2005/0066564 | A1 * | 3/2005 | Keeney et al. | 42/16 |
| 2007/0107290 | A1 * | 5/2007 | Keeney et al. | 42/16 |
| 2008/0110074 | A1 * | 5/2008 | Bucholtz et al. | 42/1.06 |

FOREIGN PATENT DOCUMENTS

| | | |
|---|---|---|
| DE | 1137353 | 9/1962 |
| GB | 559586 | 2/1944 |

* cited by examiner

*Primary Examiner*—Troy Chambers
*Assistant Examiner*—Samir Abdosh
(74) *Attorney, Agent, or Firm*—Shoemaker and Mattare

(57) ABSTRACT

A smooth-bore barrel semi-automatic shotgun include a frame comprising a breech. A barrel is slidingly mounted on the frame relative to the breech. A slide-bolt assembly, which slides relative to the breech, is adapted to close the barrel. A friction spring opposes the barrel's sliding movement relative to the frame.

24 Claims, 12 Drawing Sheets

SHORT RECOIL SEMI-AUTOMATIC SHOTGUN

The present invention is a semi-automatic shotgun, particularly a semi-automatic shotgun with smooth-bore barrel, intended for the firing of cartridges with pellets, buckshot, or slugs, for hunting use and several disciplines of sport shooting.

BACKGROUND OF THE INVENTION

In the hunting and sport shooting fields, several types of shotguns are known which differentiate for the technical features and/or the functional solutions which are adopted.

The gauge is a parameter indicative of the barrel inner diameter. According to conventional system for hunting, the gauge is indicated by a number (mostly 12 or 20, more rarely 28), which indicates how many lead balls with the diameter of the barrel are contained in one pound.

The chamber length is expressed in inches. It indicates the maximum length of the cartridge which can be contained in the chamber. The most common chamber lengths are 2¾" (corresponding to 70 mm, also called Standard), 3" (corresponding to 76 mm, also called Magnum), and 3½" (corresponding to 89 mm, also called Supermagnum). The more is the cartridge length, the higher is the amount of pellets that it may contain. To a higher amount of pellets corresponds a higher amount of powder and, consequently, a higher firing power.

Other characteristics which the different types of shotguns are distinguished from are the weapon general configuration, with fixed or tilting barrel (break-action); the barrel length, typically ranging between 560 mm and 800 mm; and the mouth choke which determines the distribution of the pattern of the shot on the target.

Furthermore, in the hunting and sport shooting fields, alongside the manual loading shotguns, semi-automatic shotguns have long been known. Such shotguns relieve the user of the obligation of necessarily manually loading the weapon. In fact, in the step which immediately follows each firing, the semi-automatic shotgun autonomously proceeds to the recocking of the mobile masses (slide-bolt assembly), the ejection of the hollow shell, and the feeding and chambering of the new ammunition.

Several types of semi-automatic shotguns are known, the operation of which is based on different principles.

A first type of semi-automatic shotgun is that called "gas-operated". In such shotgun, the energy of the gases developed by the powder explosion is exploited. A small part of such gases is drawn from the barrel through one or more holes, in order to generate an expansion inside a cylinder closed by a sliding piston. The piston thrust generates, in turn, an impulse which recocks the mobile masses, ejects the shell, and loads the new ammunition.

The piston thrust is extremely variable as a function of the force of the primary impulse generated in the chamber by the powder explosion. Such primary impulse depends on the gram weight of the cartridge which is fired, where "gram weight" means the mass of the charge of fired pellets, therefore the power of the same cartridge. The mass of the powder charge and the mass of the pellets charge are typically proportional.

The gas-operated device, in order to be able to ensure the required reliability, must necessarily be dimensioned for the operation with those cartridges having the lowest gram weight which can be chambered in the shotgun. Once the device has been properly dimensioned, the variability of the cartridges gram weight and the consequent primary impulse translate in a variability of the recocking speed. The minimum speed is the one which is necessary in order to achieve a safe operation of the weapon when a cartridge having a low gram weight is fired. The maximum speed corresponds to the firing of a cartridge having the maximum gram weight which can be chambered in the shotgun.

However, the high recocking speeds translate in high stresses and, consequently, in a decrease of the working life of the shotgun components. In the whole, this results in a short duration of the same shotgun.

In the more modern gas-operated shotguns, it has been successfully attempted to obviate the problem of the high recocking speeds by adopting shutter or self-compensating valves, which are able to exhaust the excess gas associated to the firing of the cartridges having a higher gram weight.

However, such valves, or venting systems, involve an increase of the mechanics and the costs for the shotgun.

Furthermore, the gas-operated systems require a constant maintenance, since the gas which is vented tends to foul unburnt solids, which have to be removed after firing a number of shots.

Another type of semi-automatic shotgun is the one called the "inertial" type. In this type of shotgun, the compression and the subsequent relief of a spring that is arranged between the mobile masses and the shotgun frame are exploited. The spring compression is caused by the shotgun recoil, and it is exploited in order to confer to the same masses the required recocking speed.

The shotgun with inertial operation is appreciated because it allows limiting the maximum recocking speeds and the resulting reduction of the stresses of the mechanical parts.

Furthermore, the inertial shotgun is characterized by a pronounced constructive simplicity and a reduced maintenance of use. In fact, not requiring any gas drawing, the inertial device does not undergo any "fouling". Anyway, the standard cleaning is still necessary for the chamber and the barrel, which are contacted by the firing gas.

In contrast, the low recocking speed, which is intrinsic of the inertial shotgun, may be a problem, especially when the shotgun frame has a high mass, and the fired cartridge has a low or very low gram weight. The low recocking speed translates in a low shell ejection promptness and a high risk of jamming.

Furthermore, the operation of such type of shotgun is highly affected by the user's behavior, particularly by the type of reaction which the user opposes with his/her shoulder to the shotgun stock.

A further type of semi-automatic shotgun, historically the first to be developed, is that called "barrel long recoil" type or, more simply, "long recoil". In such type of shotgun, the natural recoil exerted by the gas thrust is exploited in order to backwardly accelerate the barrel and the slide-bolt assembly therewith, and all the masses involved in the recocking movement. Suitable unlock devices located between the barrel and the bolt provide to disconnect, at the right moment, the barrel from the locking members. The right moment to disconnect the barrel from the locking members is somewhat delayed compared to the moment when the shot leaves the muzzle and, as a result, the pressure inside the barrel is drastically decreased. Thereafter, a return spring brings the barrel back to the initial position, (called the battery position), while the slide-bolt assembly, provided with its own return spring, provides for the operations of shell ejection and reloading of a new ammunition.

In the long recoil shotgun, while awaiting the coming out of the shot from the muzzle, all the impulse of the gases in chamber is used in order to accelerate the barrel and the mobile masses. In fact, their recoil motion under the action of the gases extends during the whole recocking stroke, that is for many tens of millimeters. Incidentally, the recocking stroke must be approximately as long as the cartridge length, therefore ranging between 70 mm and 89 mm.

The exploitation of all the gases impulse in the chamber translates, in the case of the firing of cartridges having a high gram weight, in high recocking speeds. The high recocking speeds involve an elevated shaking of the shotgun, a high stress of the mechanical parts, and a high recoil for the user's shoulder.

In order to minimize the adverse effects of the long recoil, several devices have been proposed. Among these, for example, the friction brakes, to be actuated only in the case of the firing of Magnum or Supermagnum cartridges. Such devices, beside having a quite poor operational reliability, force the user to an additional burden, consisting in having to set the weapon as a function of the cartridge which is fired from time to time.

SUMMARY OF THE INVENTION

The object of the present invention is to devise and provide a semi-automatic shotgun which allows at least partially obviating the drawbacks reported herein before with reference to the prior art.

Particularly, the task of the present invention is to provide a semi-automatic shotgun in which the stress peaks for the parts are minimized. Furthermore, the task of the present invention is to provide a semi-automatic shotgun having an easy operation and being reliable with any cartridge gram weight.

This object and these tasks are achieved by a shotgun as described below.

BRIEF DESCRIPTION OF THE DRAWINGS

Further features and advantages of the shotgun according to the invention will appear from the description set forth below of preferred exemplary embodiments, given by way of non-limiting example, with reference to the annexed figures, in which.

DESCRIPTION OF THE PREFERRED EMBODIMENT(S)

With reference to the above-mentioned figures, a smoothbore barrel semi-automatic shotgun according to the invention has been generally designated with 1.

In a manner known per se, the shotgun 1 according to the invention comprises a frame 6 and a barrel 5.

Figure 1:
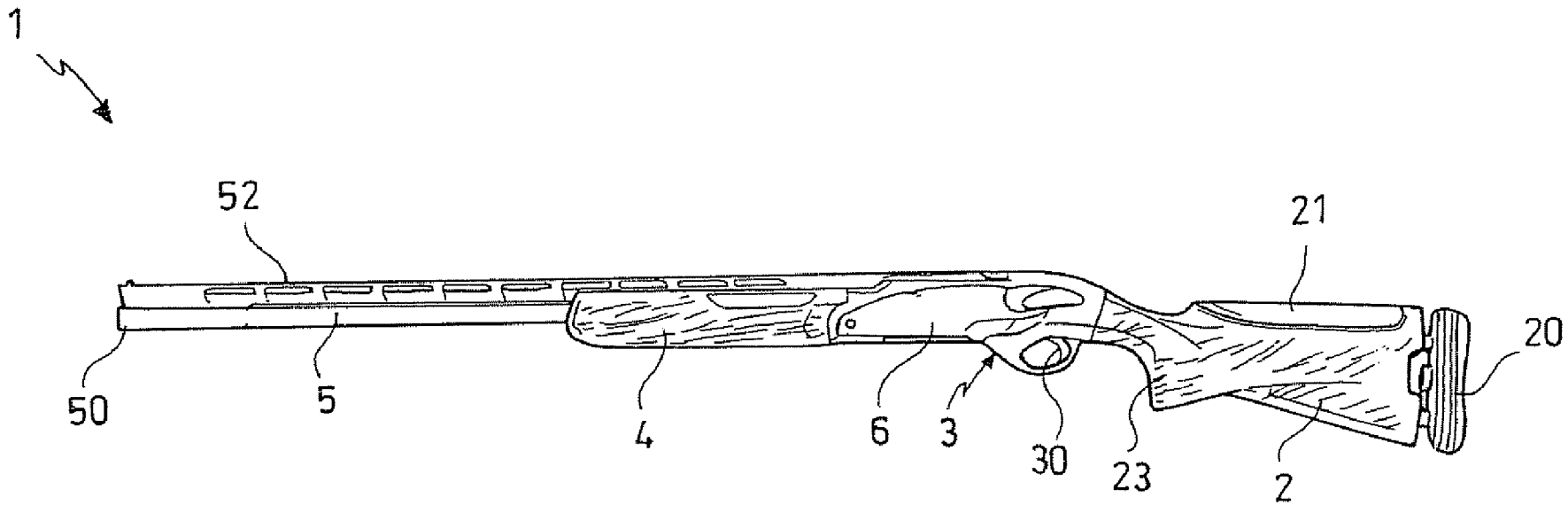
FIG. 1 illustrates a whole side view of a shotgun according to the invention.

In the specific embodiment represented in FIG. 1, the shotgun is provided with other features which are known and not necessarily essential in order to implement the invention. Specifically, the shotgun comprises a shoulder stock 2, a grip 23, a trigger assembly 3 comprising a trigger 30, and a forearm 4.

The shoulder stock 2, in the embodiment of the shotgun 1 represented in FIG. 1, comprises in turn a device 21 to set the stock drop, and an adjustable butt plate 20. Finally, the barrel 5 is single, it ends with a muzzle 50, and is overmounted by a rib 52.

Herein below, the terms "backward", "rear", or "proximal" mean a position along the shotgun 1 which, during the standard use of the shotgun, is rather near the user or the butt plate 20. In contrast, the terms "onward", "front", or "distal" mean a position along the shotgun 1 which, during the standard use of the shotgun, is rather far from the user or near the muzzle 50.

Figure 7:
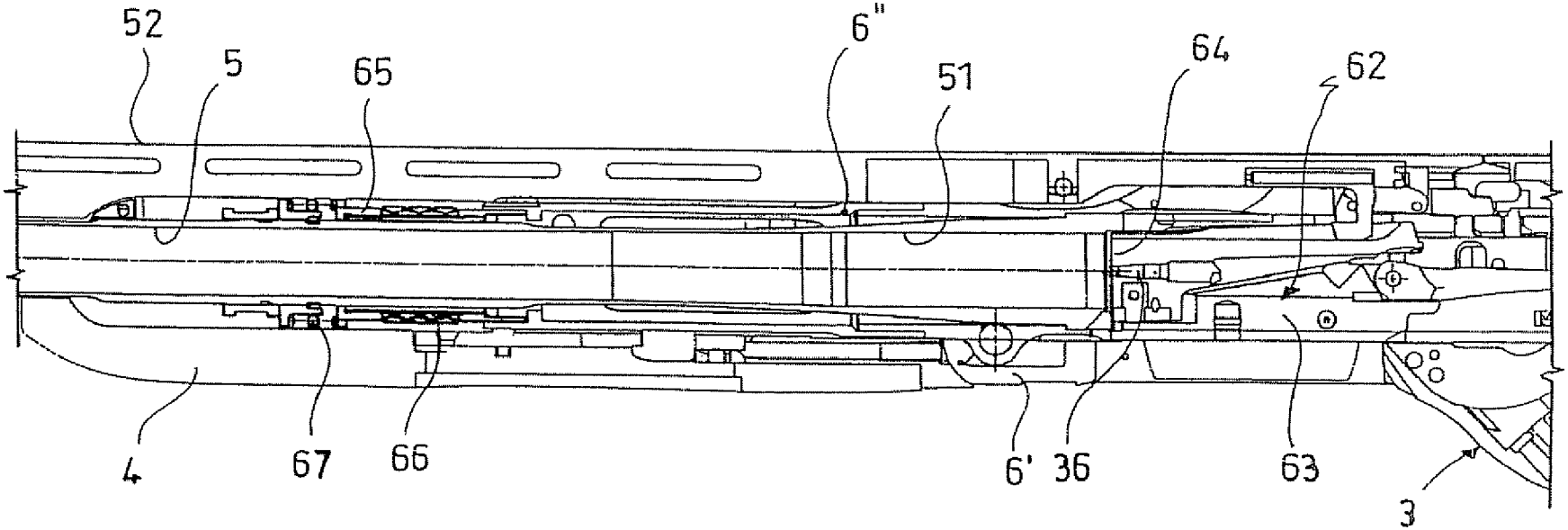
FIG. 7 illustrates a view of another shotgun according to the invention in a first configuration.
Figure 8:
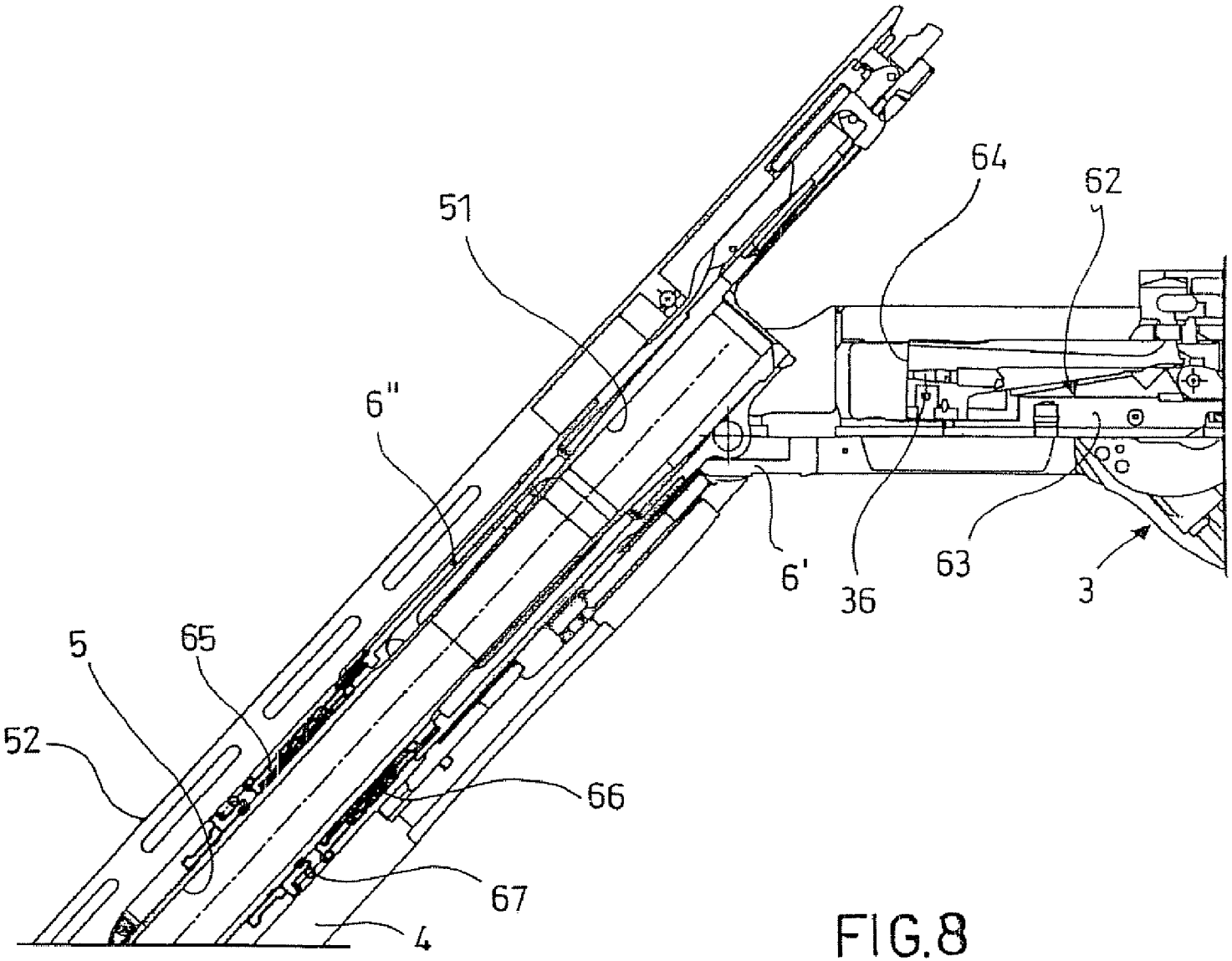
FIG. 8 illustrates the shotgun of FIG. 7 in a second configuration.

In accordance with the embodiment of the FIGS. 7 and 8, the shotgun 1 according to the invention is of the break-action type, that is in which the frame 6' comprises a receiver 6" which is hinged thereto. It further comprises an outer side cartridge carrier (not shown) adapted to contain a cartridge.

Instead, in accordance with the embodiment of the FIGS. 2 to 6, the shotgun 1 according to the invention is of the fixed barrel type. It further comprises a magazine 43 for a plurality of cartridges.

In the shotgun 1 according to the invention, the barrel 5 is slidingly mounted on the frame 6 relative to the breech 61 comprised in the frame 6. The shotgun further comprises a slide-bolt assembly 62, also sliding relative to the breech 61, adapted to close the barrel 5.

In a manner known per se, a chamber 51 is located at the barrel 5 proximal end, adapted to contain (or chamber) suitable ammunition, called cartridges, containing a charge of firing powder and a charge of pellets.

In accordance with the embodiment of the annexed figures, the slide-bolt assembly 62 comprises a bolt 64 and a slide 63, mounted so as to be able to slide one relative to the other. The bolt 64 is adapted to close the chamber 51 and to set a shape coupling with the same chamber 51, or with the rear part of the barrel 5, called the breech. The shape coupling allows the unit formed by the chamber 51 and the bolt 64 to limit the violent expansion of the gases developed, upon firing, by the cartridge powder. Relative movements between the bolt 64, the chamber 51, and/or the breech 61 allow to set and release, respectively, the shape coupling.

In accordance with the embodiment of the FIGS. 2 to 6 and 9, the shape coupling between the chamber 51 and the bolt 64 can be released by rotating the same bolt 64.

In accordance with such embodiment, the slide 63 comprises a cam surface 634 adapted to guide the bolt 64 rotational and translational movements.

In accordance with the embodiment of FIGS. 7 and 8, the shape coupling between the chamber 51 and the bolt 64 can be released by swinging the same bolt 64. Once released, the bolt 64 is able to slide along with the slide 63 and move away from the chamber 51.

In accordance with such embodiment, the slide 63 comprises a cam surface (not shown in the figures) adapted to guide the swinging and translational movement of the bolt 64.

The shotgun 1 according to the invention further comprises elastic means 65 adapted to oppose the barrel 5 sliding relative to the frame 6. Such elastic means 65 comprise a friction spring 66.

Figure 10:
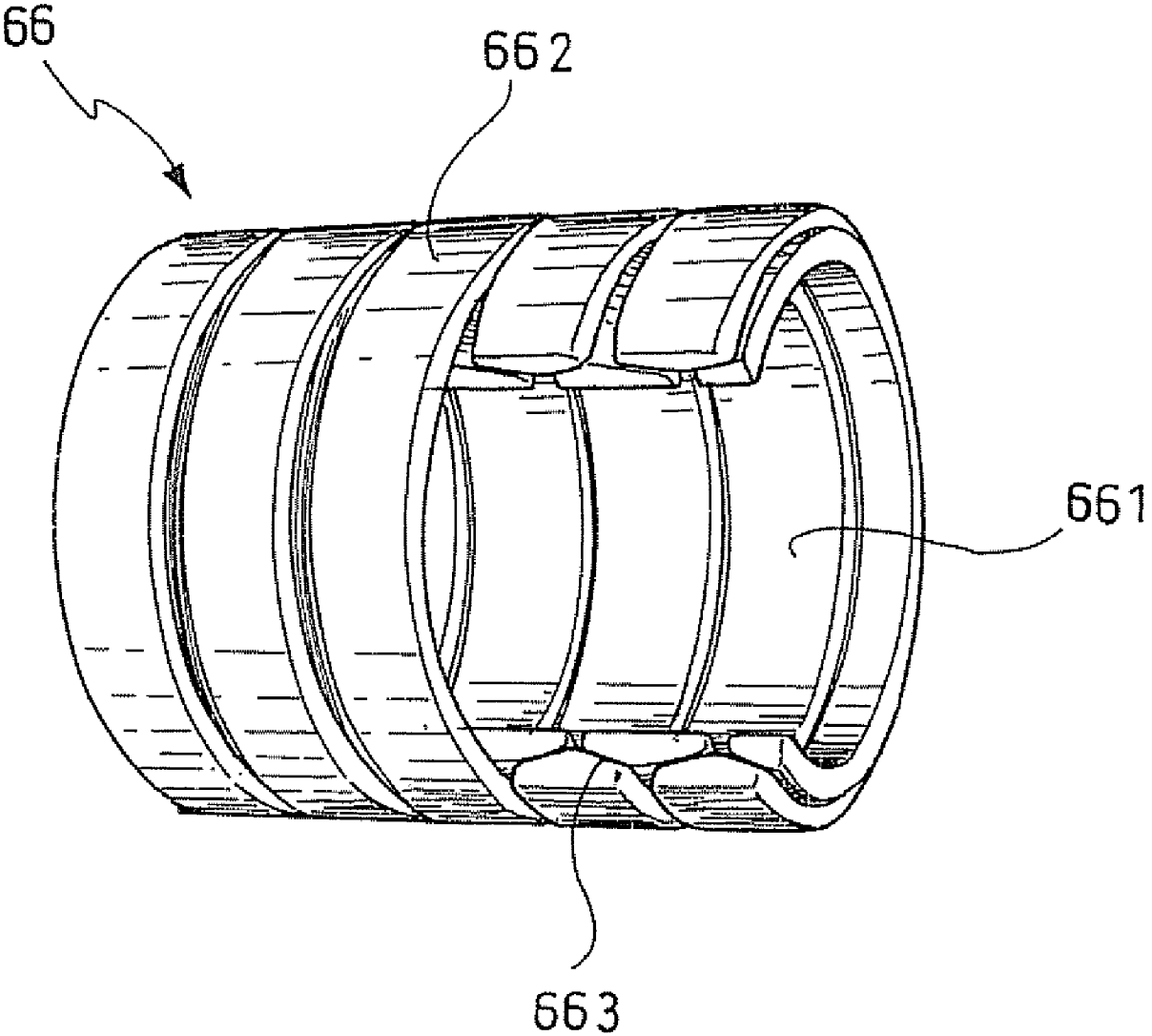
FIG. 10 illustrates, partially sectional, a friction spring comprised in the shotgun according to the invention.

A friction spring, also called ring spring, is represented in partial section in FIG. 10. The friction spring 66 comprises a plurality of inner rings 661 surrounded by a plurality of outer rings 662. The rings are of an essentially triangular or trapezoidal section, anyhow such as to form sloped surfaces. The rings are arranged so as to mutually contact the sloped surfaces, in order to create a plurality of friction surfaces 663.

When the friction spring 66 is subjected to an axial compression stress, the rings slide along the friction surfaces. In the inner rings 661 a circumferential compression strain is created which tends to decrease their diameter. On the contrary, in the outer rings 662 a circumferential traction strain is created which tends to increase their diameter.

Friction springs 66 of the type used in the shotgun 1 according to the invention are manufactured and sold under the tradename Ringfeder® by RINGFEDER VBG GMBH.

Figure 11:
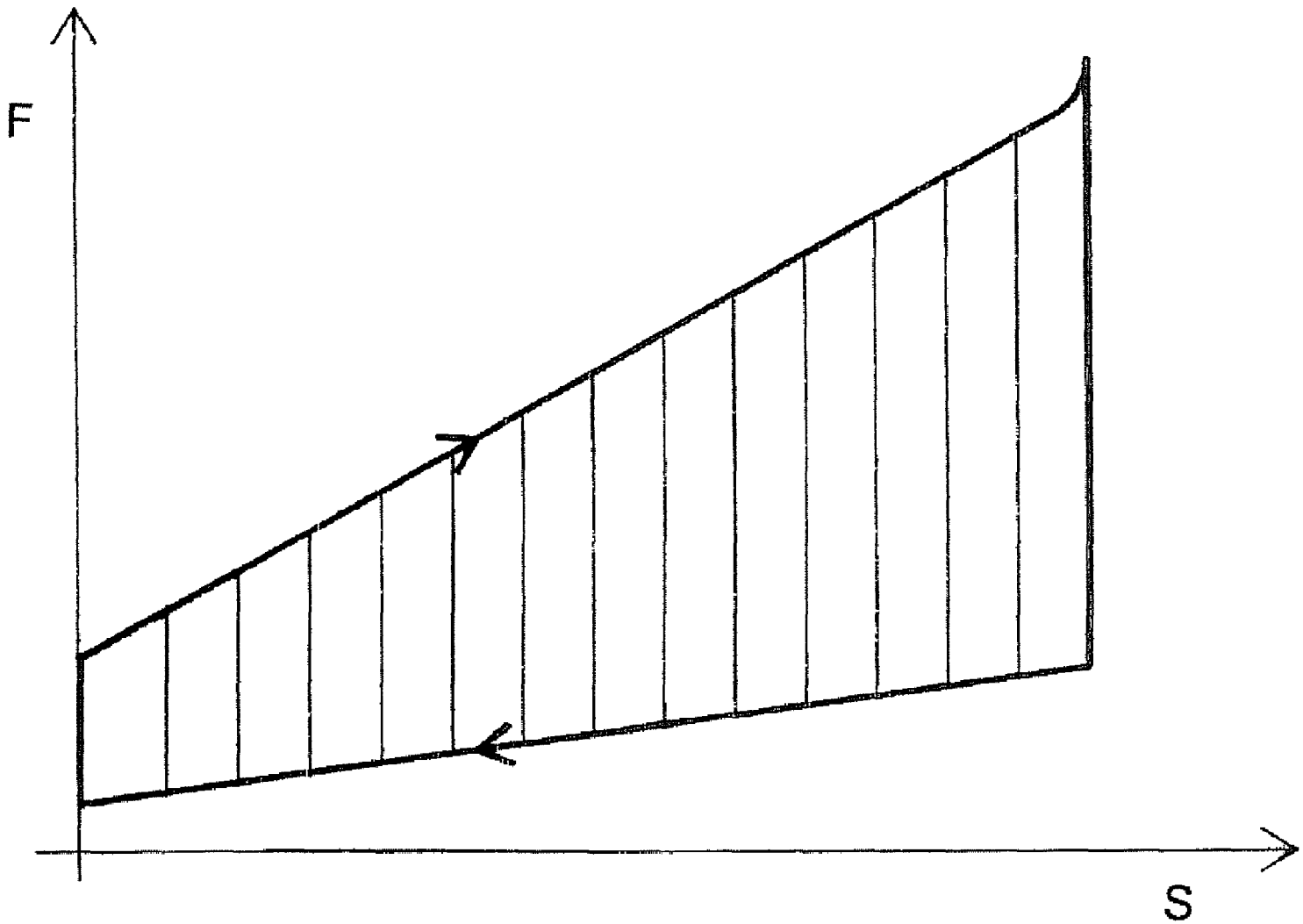
FIG. 11 illustrates the characteristic curve Force-Displacement of the spring in FIG. 10.

The characteristic curve Force-Displacement of a typical friction spring 66 is reported in FIG. 11. Compared to the curves of other types of springs, the one in FIG. 11 combines limited displacements and high forces. This allows the friction spring 66 to store a high amount of energy with short operation strokes.

As it should be further appreciated, the curve is characterized by a marked hysteresis. In other terms, the energy which is released by the spring during the discharge cycle is markedly lower than the energy which is stored during the charge cycle. In fact, the charge cycle is characterized by markedly higher forces than those of the discharge cycle, while keeping the displacement constant.

Due to such hysteresis, the friction spring 66 dissipates a relevant amount of energy in every single charge-discharge cycle, energy which is graphically represented by the dotted area in FIG. 11.

Such energy dissipation allows drastically reducing the barrel kinetic energy in the recoil stroke, therefore the energy of the resulting impacts. The impact energy reduction allows an increase of the useful life of the mechanical components of the shotgun 1.

Figure 9:
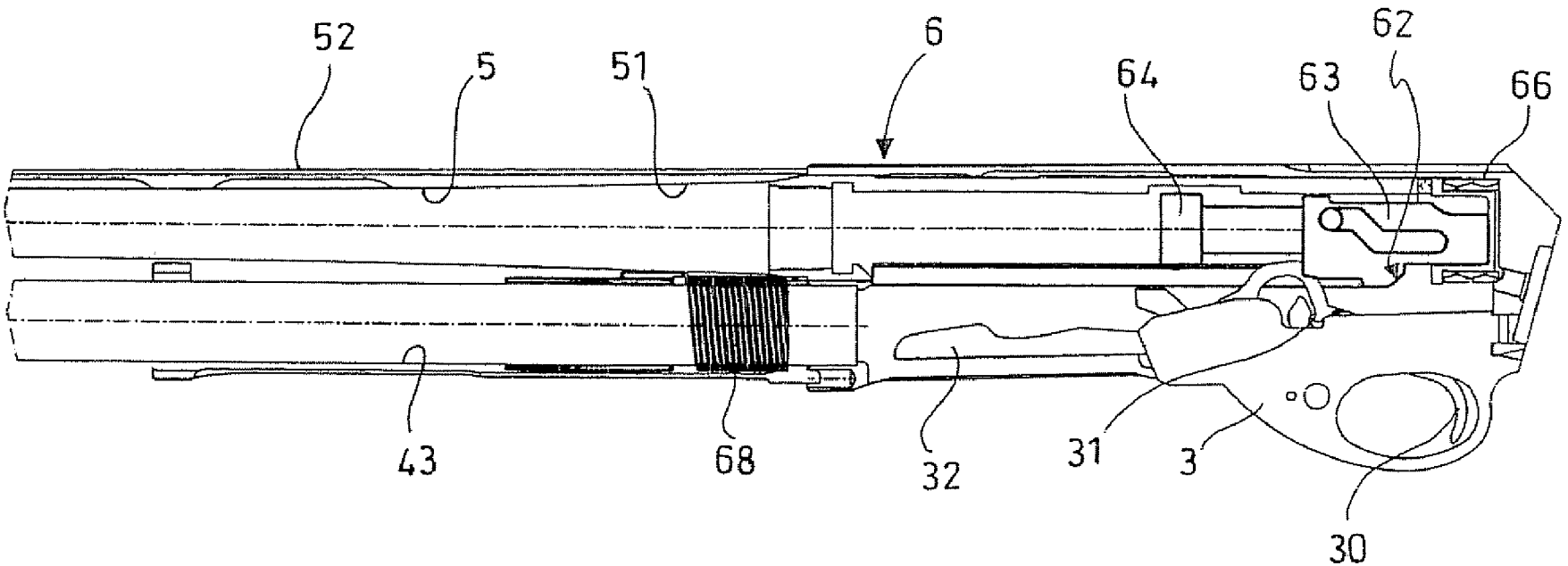
FIG. 9 illustrates a view of a further shotgun according to the invention.

In the general configuration of the shotgun 1, the friction spring 66 can take different arrangement, in order to meet specific needs. For example, in the embodiment of the FIGS. 2 to 6, the friction spring 66 is arranged around the chamber 51. In the embodiment of FIG. 7, the friction spring 66 is arranged around the barrel 5, in a more advanced position compared to the chamber 51. In the embodiment of FIG. 9, the friction spring 66 is arranged in the frame 6, in a rearmost position compared to the chamber 51. In this particular position, the friction spring 66 is also adapted to stop the stroke of the slide-bolt assembly 62.

However, in all these embodiments, the friction spring 66 has a coaxial position relative to the barrel 5.

In accordance with other embodiments, in order to meet specific needs, the friction spring 66 can take other positions, for example non-coaxial to the barrel 5.

In accordance with the embodiments of the annexed figures, the elastic means 65 also comprise a coil spring 67. The coil spring 67 takes a coaxial position relative to the friction spring 66. Furthermore, in the embodiments of the annexed figures, the coil spring 67 and the friction spring 66 are arranged in series.

The coil spring 67 has a markedly softer characteristic than the friction spring 66. In other terms, while keeping the shortening imposed to the two springs constant, the coil spring 67 reacts with a force which is much lesser than that of the friction spring 66. Furthermore, the coil spring 67 has a characteristic which, except for the intrinsic dissipation of the material, is essentially without hysteresis.

Due to these characteristics, the coil spring 67 is adapted to bring the barrel 5 back to the battery position at the end of the recoil stroke following the firing. The coil spring 67 is further adapted to keep the barrel 5 in the battery position during the shakings which are characteristic during the use of the shotgun 1.

Figure 13:
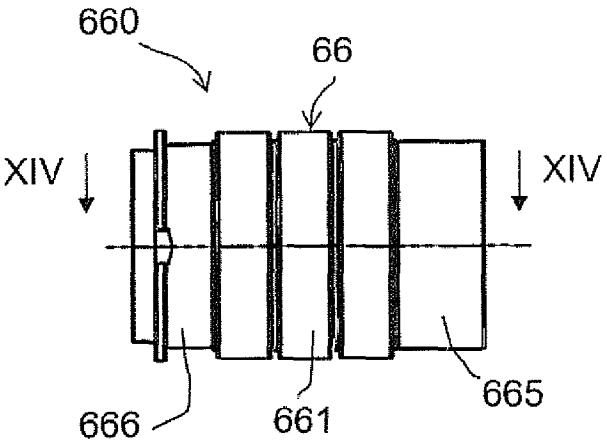
FIG. 13 illustrates a side view of the detail in FIG. 12.
Figure 14:
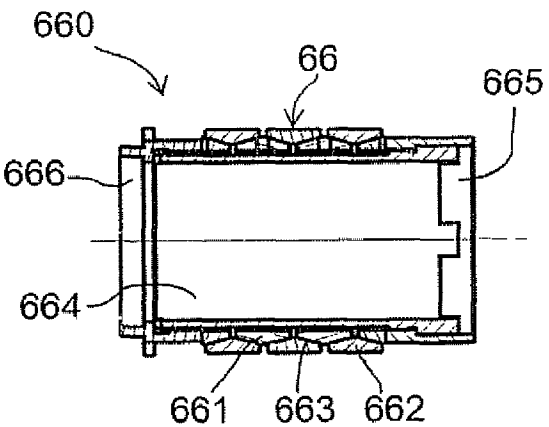
FIG. 14 illustrates the section along the XIV-XIV line of FIG. 13.
Figure 12:
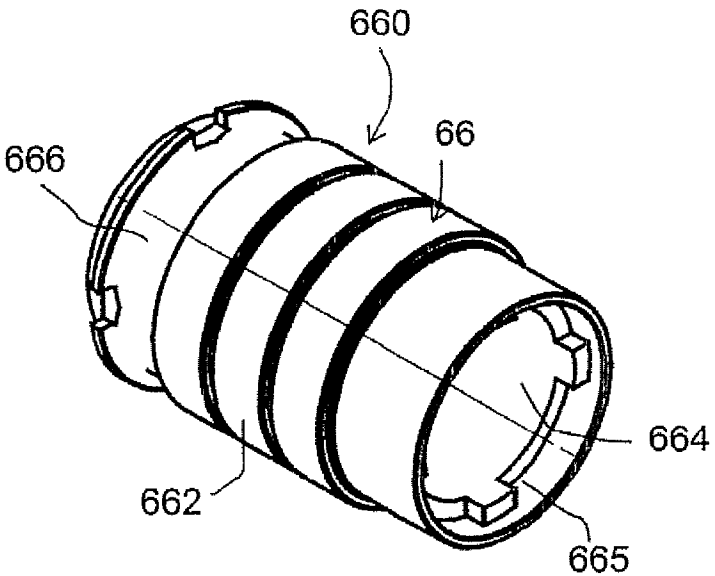
FIG. 12 illustrates a perspective view of a shotgun detail according to the invention.

The same task of bringing the barrel 5 back to the battery position at the end of its recoil stroke can be accomplished by a friction spring in which some of the outer rings 662 have been cut. The cutting of the outer rings 662 allows to soften a lot the characteristic of the friction spring 66, until—in some cases—even avoiding the need to add a coil spring 67. In accordance with some embodiments of the shotgun 1 according to the invention, the friction spring 66 is comprised in a buffer 660 of the type represented in the FIGS. 12 to 14. The buffer 660 comprises, beside the friction spring 66, an inner tube 664 on which a sliding flange 665 and an abutting flange 666 are mounted.

Each of the two flanges 665 and 666 constitutes a support in the axial direction for the friction spring 66.

The sliding flange 665 is able to slide along the inner tube 664 only in the approaching direction to the friction spring 66; on the contrary, its sliding in the opposite, removal direction from the friction spring 66 is prevented.

Instead, during the operative life of the buffer 660, the abutting flange 666 is fixed relative to the inner tube 664. Its position along the inner tube 664 is decided in the project phase and is set during the steps of assembling and/or overhauling of the buffer 660. In this way, during the assembling step of the buffer 660, the friction spring 66 is arranged abutting against the sliding flange 665 and, in turn, the abutting flange 666 is arranged abutting against the friction spring 66.

The previously described structure of the buffer 660 allows providing a compression pre-load to the friction spring 66. In such way, the spring 66 immediately reacts, also to compression displacements near to zero, with a non-null force which is decided in the project step of the buffer 660. The Force-Displacement curve of FIG. 11 relates to a friction spring 66 pre-loaded by compression.

The pre-load allows dissipating a higher amount of energy while keeping the displacement imposed to the friction spring 66 constant.

Furthermore, independently by the pre-load setting, the buffer 660 structure allows recovering all the axial clearances of the buffer 660 and the friction spring 66, so that the buffer compression is not able to produce axial displacements of the components without a reaction of the friction spring 66.

As those skilled in the art may certainly appreciate, the operations of friction spring 66 pre-load setting and clearance recovering can be accomplished also without buffer 660, by directly mounting the friction spring 66 on the shotgun 1. However, it will also be appreciated that the buffer 660 allows a higher ease and efficacy in performing these operations disjointedly from the assembling of bulky and heavy pieces, such as the barrel 5 and the frame 6.

In accordance with some embodiments, the shotgun 1 comprises other elastic means 68 adapted to bring the slide-bolt assembly 62 back to the battery position. In the embodiments of the FIGS. 9 and 2 to 6, the elastic means 68 comprise a coil spring arranged around the magazine 43 for the cartridges. In the embodiment of the FIGS. 7 and 8, the elastic means 68 comprise a spring (not shown) arranged inside the shoulder stock 2.

The elastic means 68 can comprise other types of springs, and can assume other arrangements, in order to meet specific needs.

With reference to the FIGS. 2 to 6, the operation of a shotgun 1 according to the invention during the firing and the successive reload cycle will be described herein below.

Figure 2:
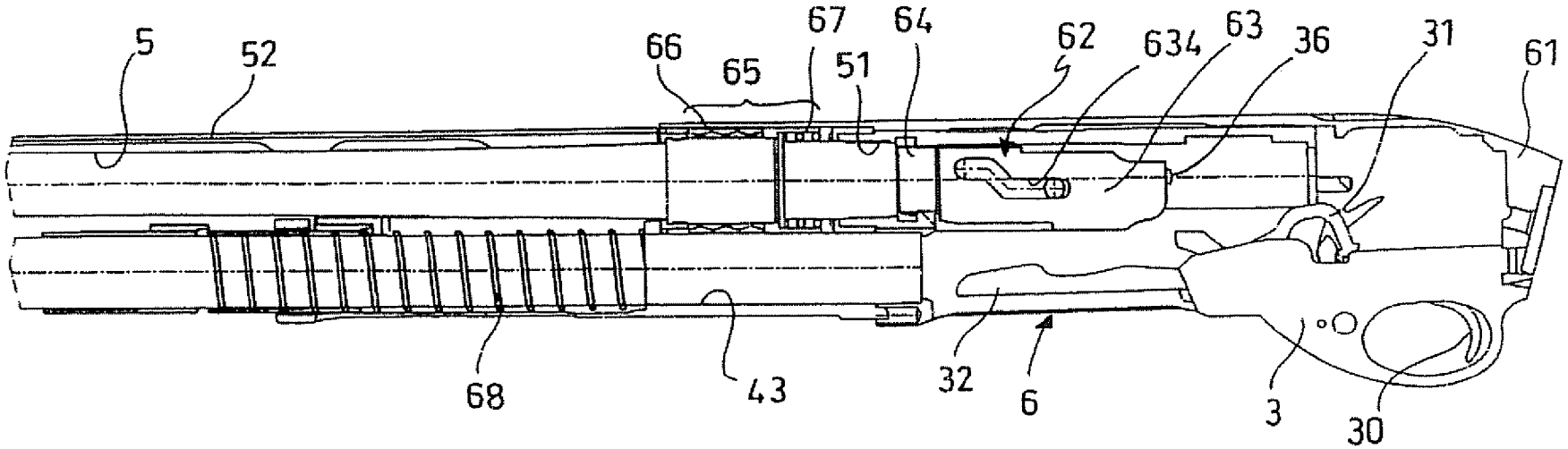
FIG. 2 illustrates a partially sectional side view of a shotgun detail according to the invention during a first step of the operation.

The configuration taken by the shotgun in FIG. 2, called the battery configuration, is that in which the shotgun is loaded and ready to fire. A cartridge (not represented for the sake of clarity) is chambered in the chamber 51, the bolt 64 closes the chamber 51, the trigger assembly 3 is cocked.

Figure 3:
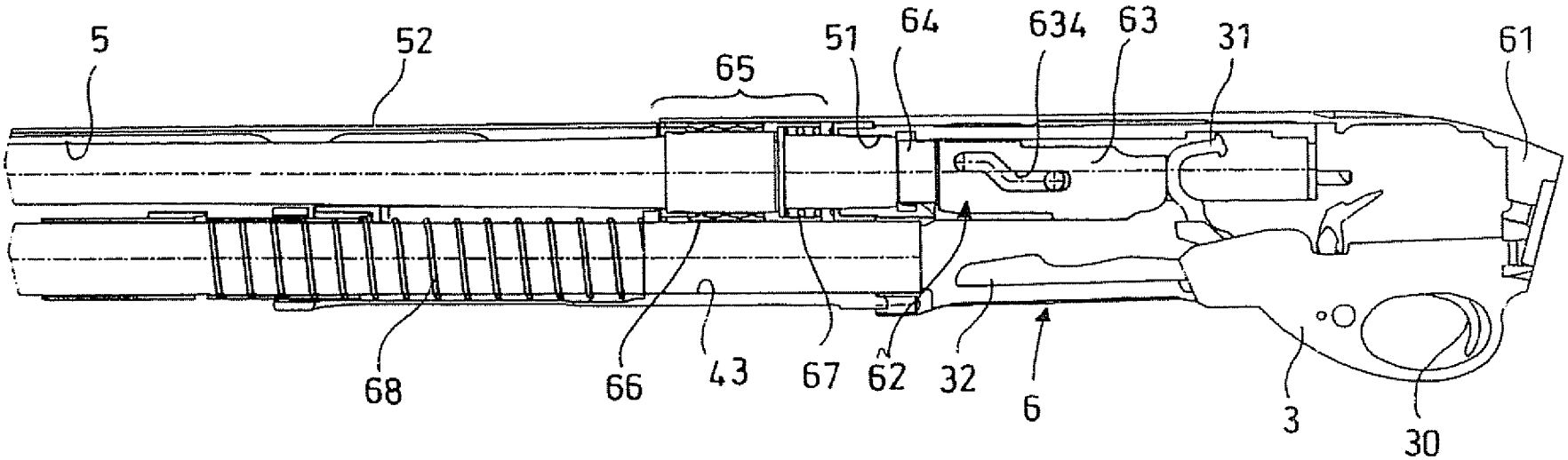
FIG. 3 illustrates a partially sectional side view of the detail of FIG. 2 during a second step of the operation.

Passing from the configuration of FIG. 2 to that of FIG. 3, the trigger 30 is pushed by actuating the trigger assembly 3 which releases the firing hammer 31.

The configuration taken by the shotgun in FIG. 3 is that at the moment of firing. The firing hammer 31 hits the firing pin 36, firing the powder charge inside the cartridge. The abrupt expansion of the gases in the chamber 51 starts to push in opposite directions the charge of pellets (forwardly) and the barrel 5 (backwardly).

Figure 4:
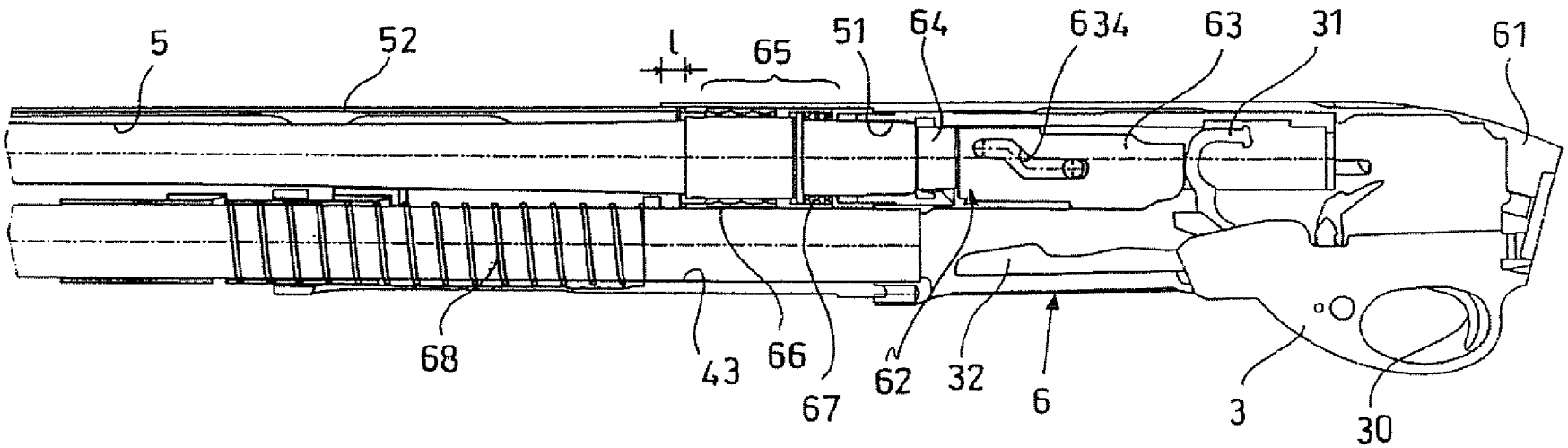
FIG. 4 illustrates a partially sectional side view of the detail of FIG. 2 during a third step of the operation.

Passing from the configuration of FIG. 3 to that of FIG. 4, the gas expansions performs the whole of its action on the barrel 5 and continues to forwardly push the pellets.

The configuration taken by the shotgun in FIG. 4 is that in which the barrel 5 has performed all the recoil stroke l. With "all the recoil stroke l" is hereby meant the recoil stroke in the strict sense of the word, in which the barrel moves essentially freely, summed to the damping stroke, in which the coil spring 67 and the friction spring 66 compression takes place. In its recoil stroke, the barrel 5 backwardly pushes the slide-bolt assembly 62, which is still closing the chamber 51.

Figure 5:
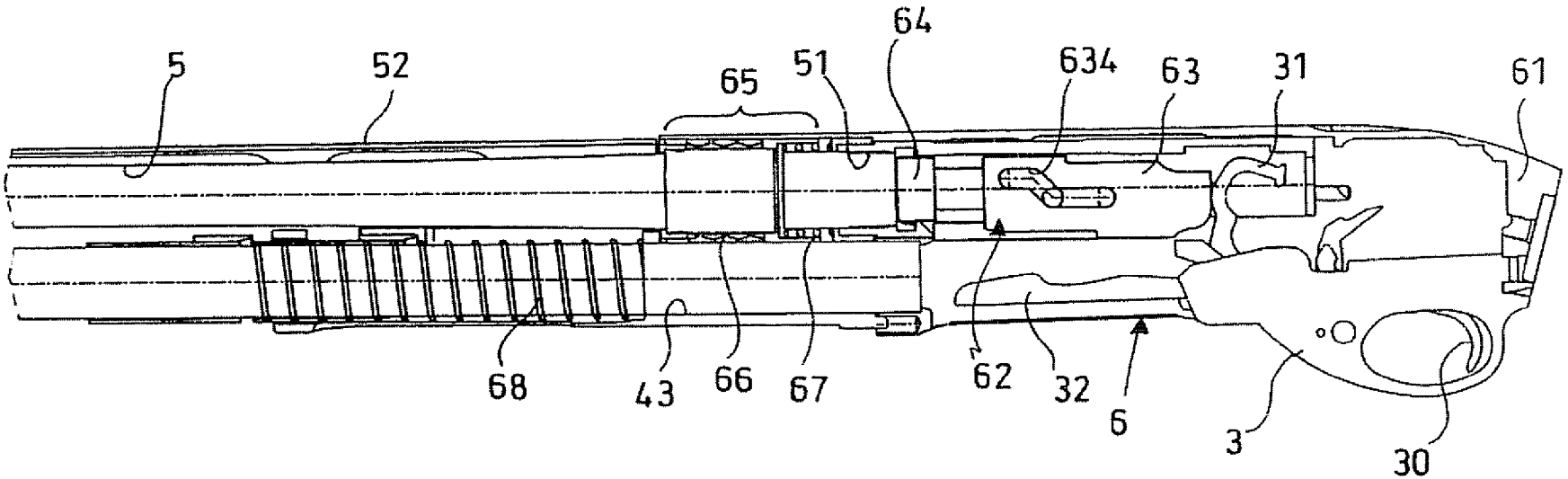
FIG. 5 illustrates a partially sectional side view of the detail of FIG. 2 during a fourth step of the operation.

Passing from the configuration of FIG. 4 to that of FIG. 5, the slide 63 proceeds in its stroke backwardly, pushing the firing hammer, thereby recocking the trigger assembly 3, the barrel 5 is brought forward again by the elastic means 65, and the pellets come out from the muzzle 50.

The configuration taken by the shotgun in FIG. 5 is that in which the barrel 5 is again in the battery position, and the pressure of the gas is drastically decreased. The slide 63, backwardly proceeding in its stroke, starts to rotate the bolt 64, still constrained to the chamber 51, through the cam surface 634. The cam surface 634 particular profile dictates the delay with which the bolt 64 starts rotating relative to the firing. The bolt 64 rotation allows for the opening of the chamber 51.

Figure 6:
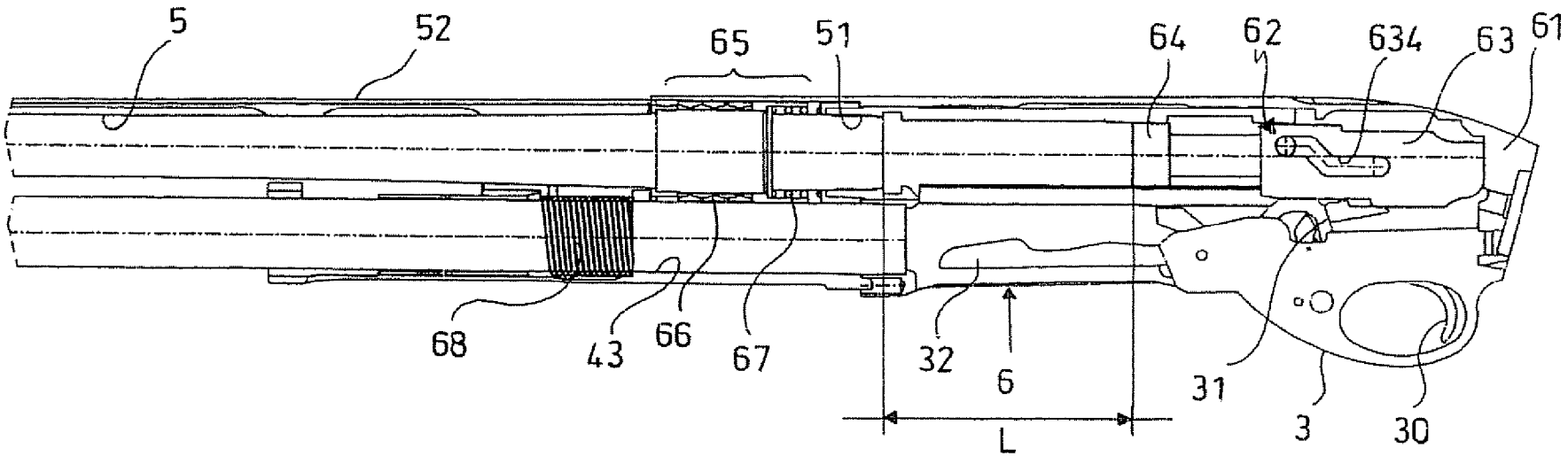
FIG. 6 illustrates a partially sectional side view of the detail of FIG. 2 during a fifth step of the operation.

Passing from the configuration of FIG. 5 to that of FIG. 6, the bolt 64 is released and, being backwardly dragged by the slide 63, it opens the chamber 51. The slide 63 finishes cocking the trigger assembly 3, and the empty cartridge or shell is ejected.

The configuration taken by the shotgun in FIG. 6 is that in which the slide 63 has reached its rearmost position. The backward stroke of the slide can stop on special dampeners. The elastic means 68 are compressed and ready to bring the slide-bolt assembly 62 back to the battery position.

Again, passing from the configuration of FIG. 6 to that of FIG. 2, the slide 63 and the bolt 64 are brought back to the battery position by the elastic means 68. During this onward stroke, the slide-bolt assembly 62 chambers a new cartridge, which is lifted by the apposite cartridge carrier 32. The bolt 64 is pushed again and rotated by the cam surface 634 of the slide 63, so as to close the chamber 51.

It should be noted that the recoil stroke of the barrel 5 is extremely reduced compared to the recoil stroke of the slide-bolt assembly 62. In this regard, it is useful to compare the configuration taken by the shotgun in FIG. 2 (battery position) to the shotgun configurations respectively taken in FIG. 4 (completely recoiled barrel 5) and in FIG. 6 (completely recoiled slide-bolt assembly 62). Particularly, all the recoil stroke l of the barrel 5 has a length less than 10 mm, preferably less than 8 mm. In contrast, the recoil stroke L of the slide-bolt assembly 62 (in the case of the FIGS. 2 to 6, see the bolt 64) has a length comparable to the cartridges length, and typically above 80 mm.

In accordance with an embodiment of the shotgun 1 according to the invention, the L/1 ratio is above 10.

From all what has been set forth above, it derives that the shotgun 1 according to the invention has an operation principle which makes it essentially capable of spontaneously matching the different cartridge gram weights which can be fired. In fact, as those skilled in the art may understand, the backward acceleration which the barrel 5 undergoes is inversely proportional to the onward acceleration which the pellets undergo. This determines the fact that when the barrel 5 has covered all the recoil stroke l, the charge of pellets has covered a barrel 5 length ranging as a function of the mass of the pellets. Particularly, a charge having lower mass will have covered a longer barrel length and, vice versa, a charge with higher mass will have covered a shorter barrel length.

Since the gas expansion supplies energy to the mobile masses only until the barrel 5 reaches the end of its recoil stroke, the cartridge gram weight increase determines a reduced increase of the energy which is transferred by the barrel 5 to the mobile masses.

How it will be now clear taking into account what has been previously said, the solutions adopted in the shotgun 1 according to the invention allow achieving a much longer operative life compared to the long recoil semi-automatic shotguns of the known type. In fact, by minimizing the energy which is transferred in the impacts, and by dissipating part of this energy through the friction springs, the shotgun 1 components are protected against the stress peaks.

Again, due to these solutions, the shotgun 1 according to the invention is, compared to the known long recoil shotguns, less subjected to shakings during the firing, and it transmits a limited impulse to the user's shoulder.

Furthermore, as compared to the gas-operated semi-automatic shotguns, the shotgun 1 according to the present invention requires an extremely reduced maintenance. In fact, not being present any gas drawing, there is no fouling of unburnt solids.

Finally, compared to the semi-automatic inertial shotguns, the shotgun 1 according to the present invention is sensibly less subject to jamming. In fact, it does not suffer from the cartridge gram weight variation, nor from the user's characteristics.

To the previously described embodiments of the shotgun, those skilled of the art, in order to meet specific, contingent needs, will be able to make modifications, adaptations, and replacements of elements with other functionally equivalent ones, without departing from the scope of the following claims. Each of the characteristics described as belonging to a possible embodiment can be implemented independently from the other embodiments described herein.

What is claimed is:

1. A semi-automatic smooth-bore barrel shotgun comprising:

a frame comprising a breech;

a barrel mounted on said frame for sliding relative to said breech;

a slide-bolt assembly, sliding relative to said breech, which is adapted to close said barrel; and elastic means adapted to oppose the sliding of said barrel relative to said frame; characterized in that said elastic means comprise a friction spring, wherein said friction spring comprises rings arranged so as to mutually contact in order to create a plurality of friction surfaces when the friction spring is subjected to an axial compression stress.

2. The shotgun according to claim 1, wherein said shotgun is of the break-action type, that is in which the frame comprises a receiver hinged thereto.

3. The shotgun according to claim 1, further comprising an outer side cartridge carrier adapted to contain a cartridge.

4. The shotgun according to claim 1, further comprising a magazine adapted to contain a plurality of cartridges.

5. The shotgun according to claim 1, wherein the barrel comprises, at the proximal end thereof, a chamber adapted to contain cartridges containing a charge of firing powder and a charge of pellets.

6. The shotgun according to claim 5, wherein the slide-bolt assembly comprises a bolt, and a slide, which are mounted so as to be able to slide one relative to the other.

7. The shotgun according to claim 6, wherein the bolt is adapted to close the chamber and to set a shape coupling with the same chamber or with the breech of the barrel.

8. The shotgun according to claim 7, wherein relative movements between the bolt and the chamber, and/or between the bolt and the breech allow setting and releasing, respectively, the shape coupling.

9. The shotgun according to claim 7, wherein the shape coupling between the chamber and the bolt can be released by rotating the same bolt.

10. The shotgun according to claim 7, wherein the shape coupling between the breech and the bolt can be released by swinging the same bolt.

11. The shotgun according to claim 6, wherein the bolt, once released, can slide in the slide and move away from the chamber, and wherein the slide comprises a cam surface adapted to guide the bolt movements.

12. The shotgun according to claim 1, wherein said friction spring comprises a plurality of inner rings surrounded by a plurality of outer rings arranged so as to create a plurality of friction surfaces.

13. The shotgun according to claim 1, wherein said friction spring has a characteristic curve Force-Displacement with a marked hysteresis, that is in which the energy released by the friction spring during the discharge cycle is markedly lower than that stored during the charge cycle.

14. The shotgun according to claim 1, wherein the friction spring is co-axially arranged to the barrel.

15. The shotgun according to claim 1, wherein the friction spring is also adapted to stop the recoil stroke of the slide-bolt assembly.

16. A semi-automatic smooth-bore barrel shotgun comprising:

a frame comprising a breech;

a barrel mounted on said frame for sliding relative to said breech;

a slide-bolt assembly, sliding relative to said breech, which is adapted to close said barrel; and elastic means adapted to oppose the sliding of said barrel relative to said frame; wherein said elastic means comprise a friction spring;

wherein said elastic means further comprise a coil spring coaxially arranged relative to the friction spring, and wherein the coil spring and the friction spring are arranged in series.

17. The shotgun according to claim 16, wherein the coil spring is adapted to bring the barrel back to the battery position at the end of the recoil stroke following the firing and to keep the barrel in the battery position despite shaking during use of the shotgun.

18. The shotgun according to claim 12, wherein in said friction spring some of the outer rings are cut.

19. The shotgun according to claim 16, wherein all the recoil stroke (l) of the barrel has a length less than 10 mm, and wherein the (L/l) ratio between the recoil stroke (L) of the slide-bolt assembly and all the recoil stroke (l) of the barrel is more than 10.

20. The shotgun according to claim 1, wherein said friction spring is pre-loaded, so as to react to compression movements near to zero with a pre-established non-null force.

21. A semi-automatic smooth-bore barrel shotgun comprising:

a frame comprising a breech;

a barrel mounted on said frame for sliding relative to said breech;

a slide-bolt assembly, sliding relative to said breech, which is adapted to close said barrel;

elastic means adapted to oppose the sliding of said barrel relative to said frame; wherein said elastic means comprise a friction spring; and a buffer comprising said friction spring, an inner tube, a sliding flange, and an abutting flange mounted on the inner tube, the sliding flange and the abutting flange constituting a rest in the axial direction for the friction spring.

22. The shotgun according to claim 21, wherein the sliding flange is able to slide along the inner tube only in the approaching direction to the friction spring, while its sliding in the opposite, removal direction from the friction spring is prevented, and wherein, during the operative life of the buffer, the abutting flange is fixed relative to the inner tube.

23. The shotgun according to claim 21, wherein the buffer provides a compression pre-load to the friction spring.

24. The shotgun according to claim 21, wherein all axial clearances of the buffer and the friction spring are recovered.

* * * * *